US006371030B1

(12) United States Patent
Gilman et al.

(10) Patent No.: US 6,371,030 B1
(45) Date of Patent: Apr. 16, 2002

(54) TRAINING PROJECTILE USING SHAPE MEMORY ALLOY MEMBERS

(75) Inventors: Stewart Gilman, Wharton; Leon Manole, Great Meadows, both of NJ (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 52 days.

(21) Appl. No.: 09/620,322

(22) Filed: Jul. 24, 2000

Related U.S. Application Data

(60) Provisional application No. 60/147,901, filed on Aug. 9, 1999.

(51) Int. Cl.[7] ..... F42B 10/48
(52) U.S. Cl. ..... 102/529; 244/3.1
(58) Field of Search ..... 102/529; 244/3.1, 244/3.27

(56) References Cited

U.S. PATENT DOCUMENTS 4,520,972 A * 6/1985 Diesinger et al. ..... 244/3.1
5,196,650 A * 3/1993 Cytron ..... 102/521
5,408,932 A * 4/1995 Hesse et al. ..... 102/501
5,874,691 A * 2/1999 Manole et al. ..... 102/529

FOREIGN PATENT DOCUMENTS

JP 02000283698 A * 10/2000 ..... F42B/10/00

* cited by examiner

*Primary Examiner*—Charles T. Jordan
*Assistant Examiner*—Kimberly S. Smith
(74) *Attorney, Agent, or Firm*—John F. Moran; Michael C. Sachs

(57) ABSTRACT

The present invention uses aerodynamic heating caused by air-friction during flight of a training projectile. The training projectile includes a nose, a body and a tail section. The body has a forwardmost end secured to the nose, and a rearwardmost end secured to the tail. Air friction during flight causes deployment of "passive" shape memory alloy (SMA) aerodynamic members in an assembly to induce drag of the training projectile thereby limiting an effective range of the projectile.

1 Claim, 4 Drawing Sheets

TRAINING PROJECTILE USING SHAPE MEMORY ALLOY MEMBERS

RELATED APPLICATIONS

This application claims benefit of filing date Aug. 9, 1999 provisionsal application 60/147,901, the entire file wrapper contents of which application are herewith incorporated by reference as though fully set forth herein at length.

GOVERNMENT INTEREST

The invention described herein, may be manufactured, used and licensed by or for the United States Government.

BACKGROUND OF THE INVENTION

1. Field of the Invention

This invention relates generally to projectiles, and in particular, to training projectiles having components for inducing in-flight aerodynamic effects on the projectile.

2. Description of the Prior Art

Use of shape memory alloys (SMA) is shown in U.S. Pat. No. 4,941,627. This technology discloses a control fin having a shape memory effect alloy to change the angle of attack of the rear stabilizer fins of a guided projectile in response to an electrical current. That disclosure includes control, and further discloses fins that impart aerodynamic or hydrodynamic lift to alter the path of the vehicle as opposed to imparting a rapid in-flight increase in aerodynamic drag to slow the vehicle down. Other limitations of this fin design include a need for a external power supply to provide an electrical current that is required to actuate the control fins. This limitation alone incurs greater increase in weight, volume and cost requirements to build the projectile.

Another training projectile is in U.S. Pat. No. 5,874,691 entitled "Kinetic Energy Collapsible Training Projectile," which is hereby incorporated by reference. This disclosure includes training projectiles comprising in combination, a nose; a body having a forewardmost end and a rearwardmost end, wherein the forewardmost end is secured to the nose; and a tail including fins secured to the rearwardmost end of the body. This is shown in FIG. 1 The body may or may not contain buttress grooves. These grooves provide an attachment surface for sabots. Sabots provide an integral metallic or composite plastic section which mates the projectile and with the gun tube or cannon tube. The sabot provides a surface for the gun gasses to act upon during the gas propulsion phase of the firing event. The gas pressure is thereby converted to mechanical energy in the form of projectile acceleration down the cannon tube.

Kinetic energy training projectiles differ from tactical projectiles in that they are not designed for target penetration. They are used for target practice. Thus, there is a need for types of training projectile rounds (munitions) that have similar physical appearance and handling characteristics (to the tactical cartridges they represent). These training projectiles have limited maximum range (for safety purposes at a training range), but can be designed to traverse several thousand meters from a firing device to a desired target.

To date there is a need in the munitions art to provide a cost effective and accurate training round that uses "passive" control mediums to limit the flight trajectory of such a round. The present invention addresses this problem.

SUMMARY OF THE INVENTION

The present invention uses aerodynamic heating caused by air-friction during flight of a training projectile. The training projectile includes a nose, a body and a tail section. The body has a forwardmost end secured to the nose, and a rearwardmost end secured to the tail. Air friction during flight causes deployment of "passive" shape memory alloy (SMA) aerodynamic members in an assembly to induce drag of the training projectile thereby limiting an effective range of the projectile. The word "passive" herein means that no ancillary electrical supply or other type of heat creating power supply is required to actuate the SMA material in this assembly, thus minimizing or eliminating added weight, volume and cost requirements of a projectile as discussed above. The types of shape memory alloy materials that can be used in the assemblies herein exhibit martensitic phase transformations. The SMA materials include elements selected from the group consisting of Nickel, Silver, Gold, Cadmium, Indium, Gallium, Thallium, Silicon, Germanium, Tin, Antimony, Zinc, Niobium, Copper, Iron, Platinum, Aluminum, Manganese, and Titanium, to provide actuation of each of the embodiments of the training projectile. Four embodiments of the present invention are discussed below.

The first embodiment includes use of SMA materials formed in strip members externally attached to the nose assembly of the projectile. These strip members deploy in-flight to induce aerodynamic drag. These strips are elongated and initially remain flat and maintain a smooth contour of the nose section prior to deployment in-flight. When deployed, these strips are designed with a spoiler-type contour dependent on required kinetic energy characteristics of the projectile and desired range of the test projectile. Variations of this embodiment include incorporating these strips either along the mid-body section or the tail section of the projectile. Various combinations of these three sections of the projectile can incorporate these strips.

The second embodiment of the invention includes a SMA material spring element within a nose assembly that causes deployment of sliders and drag inducing aerodynamic elements outwards from the nose section when in flight. This nose assembly includes the SMA spring element, a sliding lock member in cooperation with the SMA spring element, a nose tip and another spring and slider element.

The third embodiment of the invention includes a SMA ring member as part of a segmented nose assembly. This assembly includes at least a bifurcated composite body of the nose assembly that splits apart when the SMA ring member contracts (shrinks) during flight and allowing each nose segment member to splay from the root section attached to the body mid-section portion of the training projectile. The nose assembly can be made of other forms such as a three, four or more parts having substantially equal volume sections of the nose assembly.

The fourth embodiment of the invention includes a SMA materials incorporated in either the nose, body, or fin section alone or combinations of these sections. For example, the body section will be that is attached to a nose section (which can be ogival, conic, and hemispherical, in shape) and to a tail section (which can be a fin or spin stabilization device) and can incorporate a SMA in any one of these sections. This SMA body section will change shape when stimulus from aerodynamic heating occurs during flight. In this way, both the center of pressure and the center of gravity of the projectile will be affected, causing flight instability of the projectile. One possible example of this embodiment could be designed such that the body wraps around itself in a knot like fashion, while the nose section and tail section remain attached (or discarded).

One advantage of the present invention is to provide a training projectile that simulates the trajectory of an actual tactical projectile (using passive SMA components) up to and including through where the target is positioned. Upon passing through the target, the training projectile using the present invention, changes trajectory so that the projectile will fall to the ground within a predetermined distance along a predetermined path (trajectory) beyond the target (such as a maximum range requirement).

Another advantage of the present invention is to provide a training projectile that can be produced by standard machining techniques.

A further advantage of the present invention is to provide a kinetic energy training projectile that maintains predetermined aerodynamic design characteristics of actual tactical projectiles during flight.

Yet another advantage of the invention is that training round production costs can be saved by using "passive" SMA deployable members. Extensive costs can be saved as a result of using SMA in in place of expensive servo motors, explosive devices, micromechanical devices, or external power sources.

Still further advantages will become apparent by reference to the following description and the accompanying drawings.

BRIEF DESCRIPTION OF THE DRAWINGS

FIG. 2B shows an example of FIG. 2A with activated SMA strips 20.

FIG. 3B shows the invention's second embodiment with an activated SMA spring after passing through the prescribed target.

FIG. 4A depicts an SMA ring 41 before actuation which has been assembled upon a bifurcated nose section 42 with filler material 43, tack welded (44) together as a means of attachment (until SMA ring/41 actuation). Two methods of threaded attachment (45, 46) of the nose section 42 to a body member are also depicted in FIG. 4A and FIG. 4B respectively. FIG. 4C shows the nose section without filler material 48, SMA ring 41 or tack weld(44) and depicts various notched features whose function will be described later.

In the drawings, similar numerals refer to similar elements in the drawing. It should be understood that the sizes of the different components in the FIGS. are not necessarily in exact proportion or to scale, and are shown for visual clarity and for the purpose of explanation.

DETAILED DESCRIPTION OF THE PREFERRED EMBODIMENTS

Figure 1:
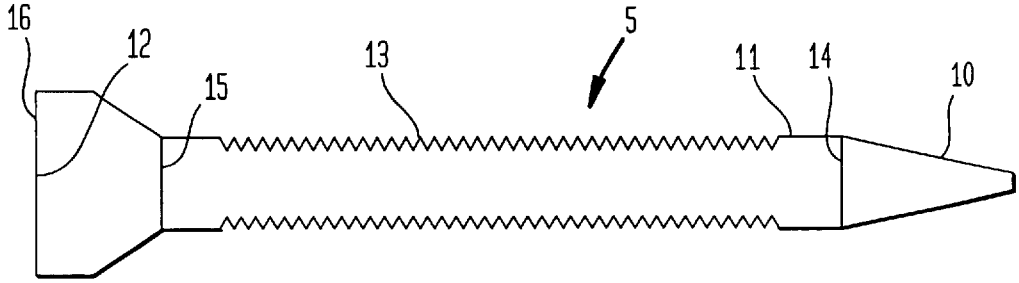
FIG. 1 (PRIOR ART)
FIG. 1 shows a projectile taught in U.S. Pat. No. 5,874,691 discussed above.

The invention uses aerodynamic heating caused by air-friction during flight of a training projectile to activate SMA components. In the embodiments that follow, the training projectile includes sections of a nose 10, a body 11 and a tail 12 with buttress grooves 13 which mate with sabot sections as in previous U.S. Pat. No. 5,874,691 and shown in FIG. 1 herein. The body has a forwardmost end 14 secured to the nose 10, and a rearwardmost end 15 secured to the tail 12. Air friction during flight causes deployment of "passive" shape memory alloy (SMA) aerodynamic members to induce drag of the training projectile, thereby limiting the effective range of the projectile. Air friction causes the projectile to heat up during flight. The SMA is set to activate at a given temperature and therefore after a certain time of flight (or distance). Moreover, the projectile will experience 10 normal flight until the SMA is activated. The types of shape memory alloy materials that can be used in the assemblies herein exhibit martensitic phase transformations. The SMA materials include elements selected from the group consisting of Ni, Ag, Au, Cd, In, Ga, Tl, Si, Ge, Sn, Sb, Zn, Nb, Cu, Fe, Pt, Al, and Ti to provide actuation of each of the embodiments of the training projectile. Preferably, the SMA material used in the invention is nitinol. Nitinol is a name for a kind of metal alloy that comprises Nickel and Titanium; it has been commercially sold by companies such as Special Metals Corporation, Hartford, N.Y., Raychem Corp. and Memory Corp. In one embodiment, it is approximately 50% Nickel and 50% Titanium; varying the respective percentages can alter its shape memory properties. The greater the proportion of Nickel with respect to Titanium, the lower the temperature at which the particular Nitinol will deform. Temperature is imparted to a Nitinol member, by example(s) described herein, through air friction with the rushing air in flight. Preliminary results show that approximately 53% Titantium versus 47% Nickel can bring desirable results.

Referring to FIG. 1, a generalized training projectile 5 comprises a windshield or nose 10, a body 11, and a tail 12. The nose 10 may be a conventional, spike, ogive or rounded nose, and is secured to the forwardmost end 14 of the body 11 and may be secured by means of a threaded member 15. The rearwardmost end 15 of the body 11 is secured to the tail 12 and may be secured by a threaded member 19. The tail 12 is fitted with fins 16, and ensures that the projectile 5 spins when fired from a smooth bore or non-rifled system. The body 11 is generally cylindrically shaped, and includes peripheral buttress grooves 13. The diameter of the body 11 is smaller than the inside diameter of the bore of tube from which the projectile is fired. An obturator and a sabot may be fastened about the body 11 to provide a friction fit between the bore of the cannon and the projectile 5, and to prevent forward thrust gasses from escaping from the bore prior to the escape of the projectile 5 leaving the gun tube when fired. The nose 10, the body 11 and the tail 12 have a common longitudinal axis.

Examples of types of munitions that the invention can be used for include, artillery, tank, medium caliber and small caliber ammunition. This invention is also suitable for use with a proportional drag control system munition.

Figure 2A:
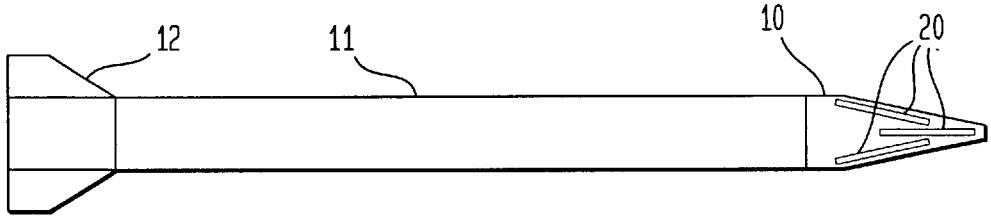
FIGS. 2A, 2B, 2C, and 2D show partial cross-sectional side views of a training projectile according to the first embodiment of the invention using SMA strips attached to the nose and/or mid-section and/or tail portions of the projectile respectively.
Figure 2B:
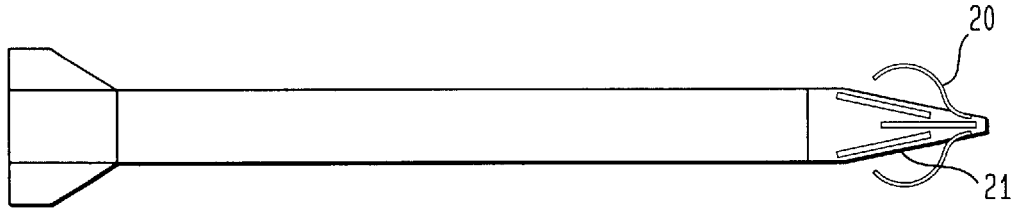
Figure 2C:
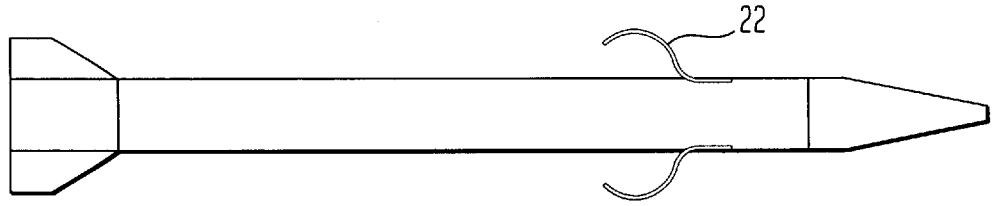
Figure 2D:
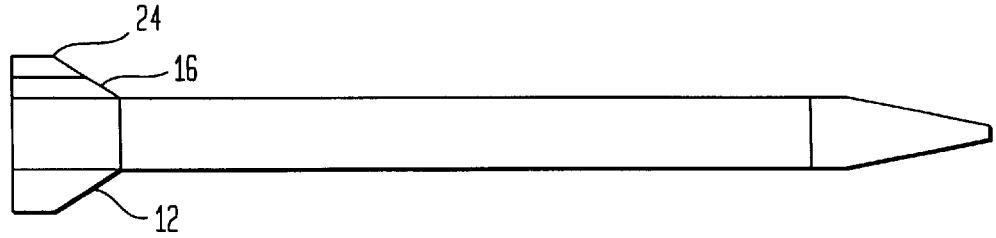

In FIGS. 2A and 2B, in exemplary form (in FIG. 2A), the nose assembly of the projectile is shown before firing of the projectile, while in flight and prior to activation (The first embodiment includes SMA strip members (20, 22, 24) that are externally attached to various sections of a projectile). FIG. 2D. While in flight with these strips deploy (FIGS. 2B, 2C, 2D). These strip members deploy in flight (after encountering the target at a preset distance) to induce aerodynamic drag and enables the projectile to land within a specified training range. These strips are elongated and initially remain flat and maintain a smooth contour of the nose section prior to deployment in-flight. Strips 20, are placed in grooves 21 which allow the strip to lie flush with the external surface of the projectile. When deployed, these strips are designed with a spoiler-type contour dependent on required kinetic energy characteristics of the projectile and desired range of the test projectile (FIG. 2D). Variations of This embodiment includes using these strips either along the mid-body section as shown in FIG. 2C (as 22) or the tail section of the projectile shown in FIG. 2D (as 24).

Referring to FIGS. 2A and 2B, The training projectile has a nose section 10 having grooves 21 machined (milled) for the purpose of containing SMA material strips. These strips are trained (through heat treatment processes) to change shape at a pre-determined temperature. Upon aerodynamic heating, these strips will activate thereby changing into their pre-determined shape. This shape can take the form of most any shape so as to influence the stability of the projectile. An example of a pre-determined shape is shown in FIGS. 2B when the strips are deployed in-flight. The optimal shape is one that induces highest possible air-flow drag during a portion of flight of the projectile.

The SMA material strips can be attached to the nose 10 by use of a screw, or other well known techniques such as welding, adhesives and so on. For example, a strong adhesive can also be used to provide rigid attachment to the nose but a mechanical means of attachment is a preferred method of attachment. The SMA material strips (20, 22, and 24) 20 can be symmetrically disposed around the nose or may be asymmetrically distributed. The more strips used,(the more surface area covered) provides for the most optimal drag characteristics. Fewer strips can also provide the desired effect necessary to de-stabilize the projectile during flight. Five strips situated asymmetrically is a preferred manner of designing the training projectile.

Referring to FIG. 2C, these SMA strips can be part of the mid-section having grooves machined (milled) for attaching SMA material strips to the projectile. In FIG. 2D, these SMA strips 24 are part of the tail 12 or fin 17 section having grooves machined (milled) for attaching SMA material strips to the projectile. Various combinations Additionally, these strips can be used in any combination on portions of the projectile such as the nose and tail section, the nose and body section or the body and tail section.

The second embodiment of the invention, in exemplary form, includes SMA spring elements within a nose assembly that cause deployment of sliders and drag inducing aerodynamic elements outwards from the nose section when in flight. This nose assembly includes the SMA spring element, a sliding lock member in cooperation with the SMA spring element, a nose tip and another spring and slider element.

Figure 3A:
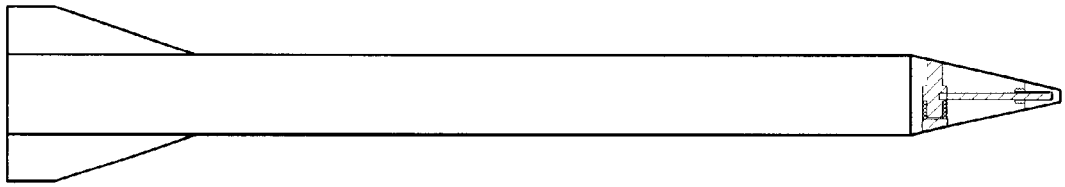
FIGS. 3A and 3B shows a cross sectional view of the training projectile according to the second embodiment of the invention using an SMA spring with slider lock mechanism in the nose section of a projectile in the not activated initial stage of flight prior to target.
Figure 3B:
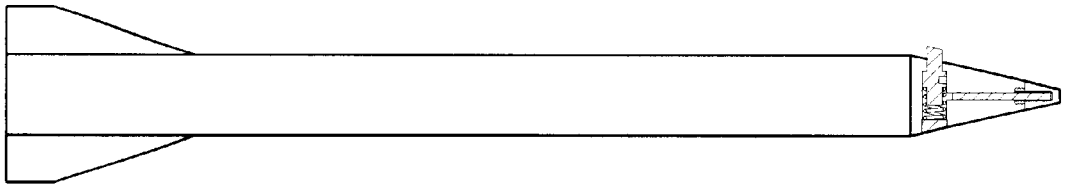
Figure 3C:
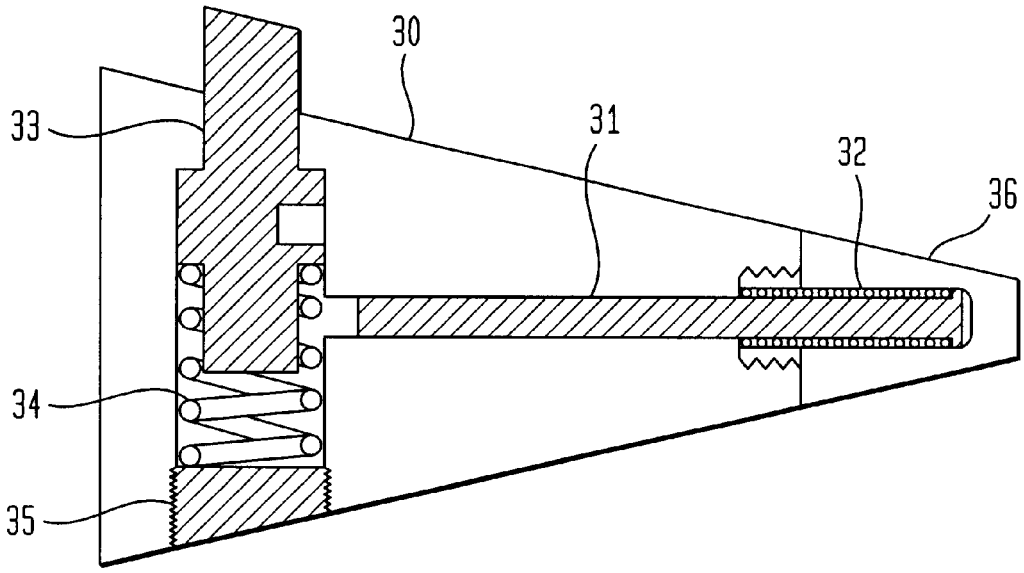
FIG. 3C shows an enlarged view of a portion of the embodiment shown in FIG. 3B.

Referring to FIGS. 3A, 3B and 3C, the projectile in this embodiment of the invention has a nose section containing a SMA material spring 32, ordinary metallic material spring 34, capture slide 33, threaded plug 35, threaded nose tip 36, sliding lock 31, and nose housing 30. This embodiment activates through aerodynamic heating wherein the nose tip 36 heats up as a result of the friction caused from aerodynamic heating. Heat is transferred to the SMA material spring and the sliding lock. As the SMA material spring heats, it reverts to its trained or pre-determined shape which in this case is the expanded form of the spring. As the spring expands it applies a force to the sliding lock 31. The sliding lock in turn pulls away from the capture slide 33 thereby unlocking the force of the larger ordinary spring 34. The ordinary spring 34 applies its force to the capture slide 33 and pushes it so a section or the capture slide is exposed to the air-stream. This section that is displaced beyond the boundaries of the nose housing 30 disrupts the airflow to one side of the projectile. This provides two functions. Initially, it destabilizes the projectile through mass imbalance. Next, it disrupts the airflow to one side of the projectile. Both actions contribute to destabilizing the projectile and limit the projectile's range and cause it to fall to the ground at a predetermined distance from the gun. The range of a training projectile is governed by the SMA material used, mass of SMA material used, heat transfer characteristics depending on how the SMA material is attached to the projectile. By varying the temperature training of the SMA material spring, the amount of metal used as a heat sink for the forward nose housing 30 the distance that the projectile will be forced to fall to the ground can be varied.

The SMA spring 32 is fitted on a shaft or sliding lock 31. In operation, when the projectile is fired, the projectile travels down range and aerodynamic friction heats the forward nose tip 36 which is made of a highly heat conductive material such as copper or cast aluminum or other metallic material. Heat transfers readily from the forward nose piece to the shaft or sliding lock 31 which in turn transfers heat to the SMA material spring 32. The spring preferably made of nitinol is trained to expand when heated. An activation temperature of around 180 degrees F. can be used. The projectile can fly further if a higher temperature designation is selected to train the SMA material spring. Once heated to a designed predetermined temperature, the spring applies a force, thereby pulling the sliding lock 31 out of its captured position in the capture slide or actuation pin 33). This in turn allows the ordinary spring 34 to apply a greater force to the pop out button or capture slide 33. The pop out button or capture slide 33 in turn, extends out the side of the nose of the projectile remaining in place as a result of the force created by the ordinary spring 34.

The third embodiment of the invention uses a SMA ring member as part of a segmented nose assembly. This assembly includes at least a bifurcated composite body of the nose assembly that splits apart when the SMA ring member is shrinks expands during flight and allowing the each nose segment member to splay from the root section attached to the body mid-section portion of the training projectile. The nose assembly can be made of other forms such as a three, four or more parts having substantially equal volume sections of the nose assembly.

Referring to FIGS. 4A, 4B, 4C and 4D, the nose section as shown includes a SMA material ring 41, nose housing 42 comprising of two or more equal sections which are tack welded 44 The tack weld is necessary to hold the sections together for assembly to a body section and to provide integrity for aeroballistic flight until the nitinol ring is activated from aerodynamic heating, filler 50 composite material, plastic, rubber, weak metallic, ceramic material). Two versions of threads are possible.

Figure 4A:
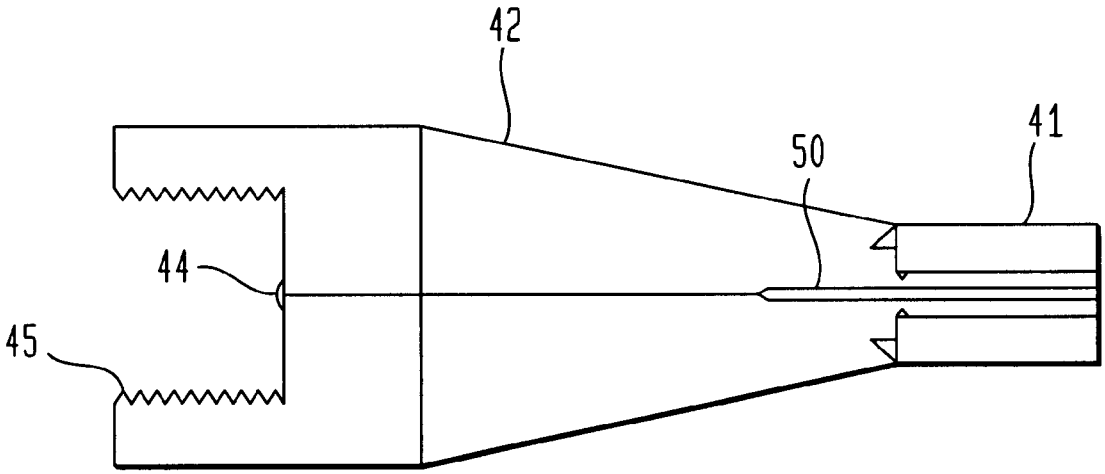
FIGS. 4A, 4B, 4C and 4D show partial cross-sectional side views of a training projectile nose according to the third embodiment of the invention using an SMA ring before and after actuation.
Figure 4B:
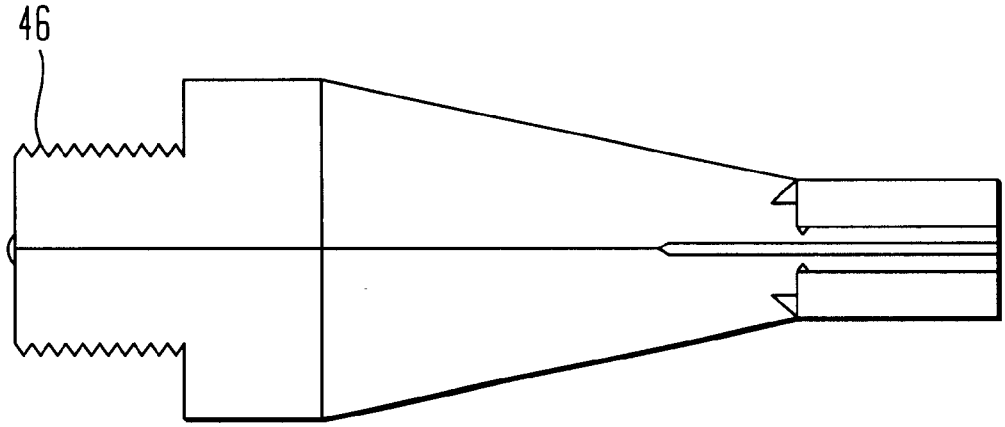
Figure 4C:
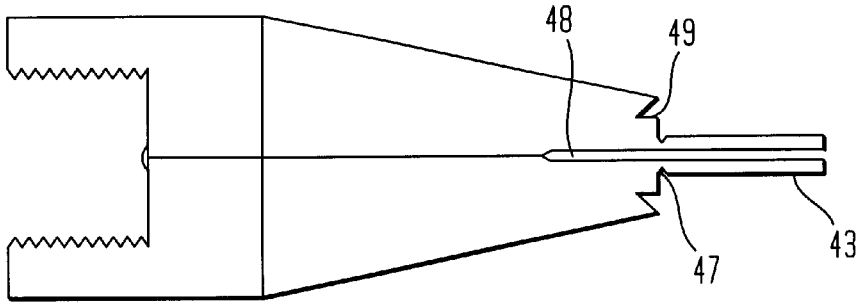
Figure 4D:
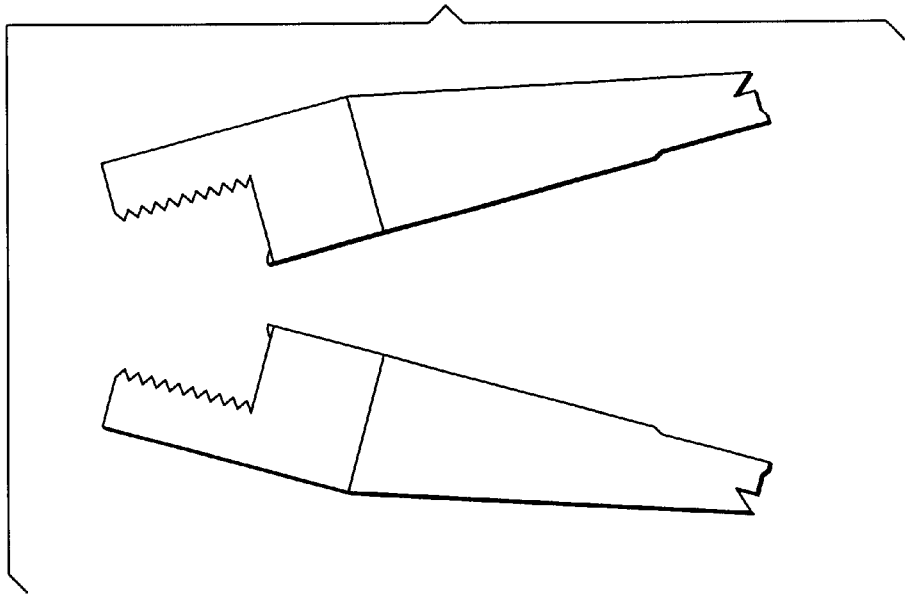

FIG. 4A shows these threads 45 on the inner cavity. FIG. 4B shows these threads 46 on the outer surface as an alternative design. In FIG. 4D, FIG. 4C the nose section 42 is shown without the nitinol ring 41 and filler material shown 50. The shear notch 47 provides a prestressed section on the nose housing 42 which is designed to break when the nitinol ring 41 activates. The clamping force from the nitinol ring allows this section to fracture at this notch. The clamping gap 48 provides a space for the cantilevered section to bend and break upon activation of the nitinol ring 41. The wind scoop 49 provides increased exposed surface area to the supersonic airstream to facilitate the nose housing 42 to break apart after nitinol ring 41 activation.

During initial assembly of the training projectile, the SMA ring 41 is cryrogenically cooled (as an example, various methods of cooling could include, cryogenic, freon 30 gas, etc . . . ) are to "expand" (SMA material nitinol expands when cooled). Once cooled and expanded, the SMA ring is placed over the body sections nose tube 43. During training exercises and when the projectile is fired, air friction causes this ring made of SMA material 41 to shrink over the notched sections. which hold the entire projectile together. Once the SMA material reaches a pre-determined temperature, which occurs at a pre-determined distance down range, the SMA material "shrinking" action breaks at the notched sections 47 of the nose of the projectile. The nose tube 43 and SMA ring 41 discard. This inturn allows the supersonic air stream to act upon the air scoops (FIG. 4C., 49) causing the nose section to split the projectile nose in multiple pieces, FIG. 4D. This in turn causes a loss of stability to the projectile and consequently limits the range of the projectile.

Figure 5:
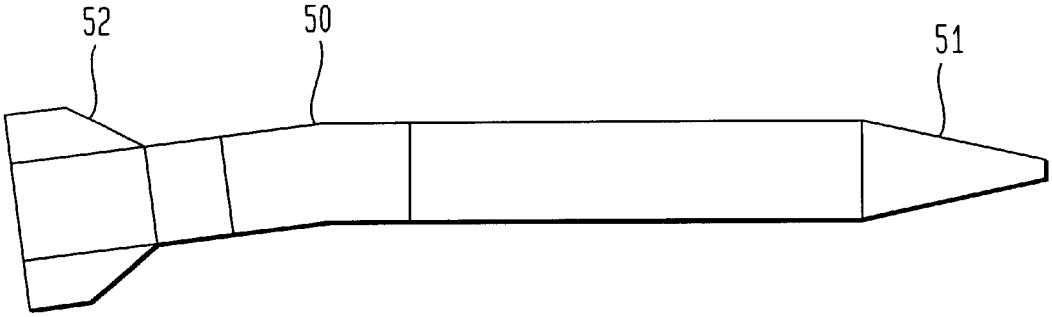
FIG. 5 shows a fourth embodiment of the invention.

Referring to FIG. 5, the body section is as shown. a fourth embodiment of the invention is shown using a SMA body section 50. This body section is attached to a nose section 51 (which can be ogival, conic, hemispherical, in shape) and to a tail section 52 (which can be a fin or spin stabilization device). The SMA body section changes shape upon stimulus when aerodynamic heating occurs. This in turn causes a center of pressure and center of gravity of the projectile to be affected, causing instability in the flight of that projectile. One possible example of operation of this embodiment where the could be designed such that body 50 kinks in mid section forming a approximately 90 degree bend. Other forms of deformation of the body section 50 can occur with only partial bending, while the nose section and tail section remain attached. (or discard. Optionally, these these sections can be discarded. Moreover, the SMA body 50 can form only a partial section of the body portion of the projectile.

What is claimed is:

1. A training projectile comprising: a nose, a body having a forewardmost end and a rearwardmost end, the forewardmost end being secured to the nose; a tail including fins secured to the rearwardmost end of the body; and at least one passive shape memory alloy controlling member that forms part of the projectile, wherein when the projectile is fired, the shape memory alloy member effectuates aerodynamic drag of the projectile by causing drag inducing members of the projectile to deploy, thereby controlling and limiting range of the projectile when fired, wherein the at least one shape memory alloy controlling member comprises a shape memory alloy spring element within the nose section, a spring-biased slider member that slides out from the nose section for inducing drag when in flight, a sliding latch member in cooperation with the shape memory alloy spring element, a nose tip, wherein when the shape memory alloy spring deforms during flight, the sliding latch member allows release of the spring biased slider member that is deployed outward from the nose section.

* * * * *